US005898413A

United States Patent [19]

Mandai et al.

[11] Patent Number: 5,898,413

[45] Date of Patent: Apr. 27, 1999

[54] SURFACE MOUNT ANTENNA

[75] Inventors: Harufumi Mandai, Takatsuki; Kenji Asakura, Yasu-gun; Teruhisa Tsuru, Kameoka; Seiji Kanba, Otsu, all of Japan

[73] Assignee: Murata Manufacturing Co., Ltd., Japan

[21] Appl. No.: 08/994,573

[22] Filed: Dec. 19, 1997

Related U.S. Application Data

[63] Continuation of application No. 08/686,498, Aug. 22, 1996, abandoned.

[30] Foreign Application Priority Data

Aug. 23, 1995 [JP] Japan ..... 7-214898

[51] Int. Cl.[6] ..... H01Q 1/24; H01Q 11/08

[52] U.S. Cl. ..... 343/895; 343/702; 343/872

[58] Field of Search ..... 343/895, 702, 343/787, 788, 718, 873, 872; H01Q 1/24, 11/08

[56] References Cited

U.S. PATENT DOCUMENTS

| | | | |
|---|---|---|---|
| 2,472,106 | 6/1949 | Hansen | 343/727 |
| 5,136,303 | 8/1992 | Cho et al. | 343/718 |
| 5,250,923 | 10/1993 | Ushiro et al. | 336/83 |
| 5,341,148 | 8/1994 | Walter et al. | 343/895 |
| 5,412,392 | 5/1995 | Tsunekawa | 343/702 |
| 5,541,610 | 7/1996 | Imanishi et al. | 343/895 |

*Primary Examiner*—Hoanganh Le

*Attorney, Agent, or Firm*—Ostrolenk, Faber, Gerb & Soffen, LLP

[57] ABSTRACT

A surface mount antenna having increased mechanical strength, and whose properties do not deteriorate when exposed to heat and moisture. The surface mount antenna includes a substrate, and a conductive portion in or on the substrate, with an electrical supply terminal formed on a surface of the substrate in order to apply voltage to the conductive portion. A covering material is provided to cover the substrate by coating, dipping, or the like.

16 Claims, 3 Drawing Sheets

SURFACE MOUNT ANTENNA

This is a continuation of application Ser. No. 08/686,498, filed Aug. 22, 1996, now abandoned.

BACKGROUND OF THE INVENTION

1. Field of the Invention

The present invention relates to a surface mount antenna, and, more particularly, to a surface mount antenna for use in mobile unit communication or local area networks (LAN).

2. Description of the Related Art

A description will now be given of a construction of a conventional surface mount antenna, with reference to FIG. 6.

Referring to FIG. 6, reference numeral 30 denotes a surface mount antenna comprising a substrate 31 formed by layers of ceramic sheets placed upon each other, with a conductor portion interposed therebetween. An electrical supply terminal 32 is formed on a surface of the substrate 31.

During handling of the surface mount antenna 30, however, the antenna may break when it is chipped or when it drops. In addition, the properties of the antenna 30 may deteriorate, when it is used under high temperature and humidity conditions.

SUMMARY OF THE INVENTION

Accordingly, an object of the present invention is to provide a surface mount antenna which has high mechanical strength and does not deteriorate when exposed to heat and moisture.

To this end, according to the invention, there is provided a surface mount antenna comprising a substrate; a conductive portion in or on a surface of the substrate; an electrical supply terminal on a surface of the substrate for applying voltage to the conductive portion; and a covering material covering at least a portion of the substrate.

According to the surface mount antenna of the present invention, it is possible to prevent breaking of the antenna when it comes into contact with another object or when it drops, since the covering material mechanically protects the substrate. In addition, it is possible to prevent deterioration of the antenna properties, when the antenna is used under high temperature and humidity conditions, since the covering material protects it from heat and moisture.

Other features and advantages of the present invention will become apparent from the following description of the invention which refers to the accompanying drawings.

DETAILED DESCRIPTION OF EMBODIMENTS OF THE INVENTION

Figure 2:
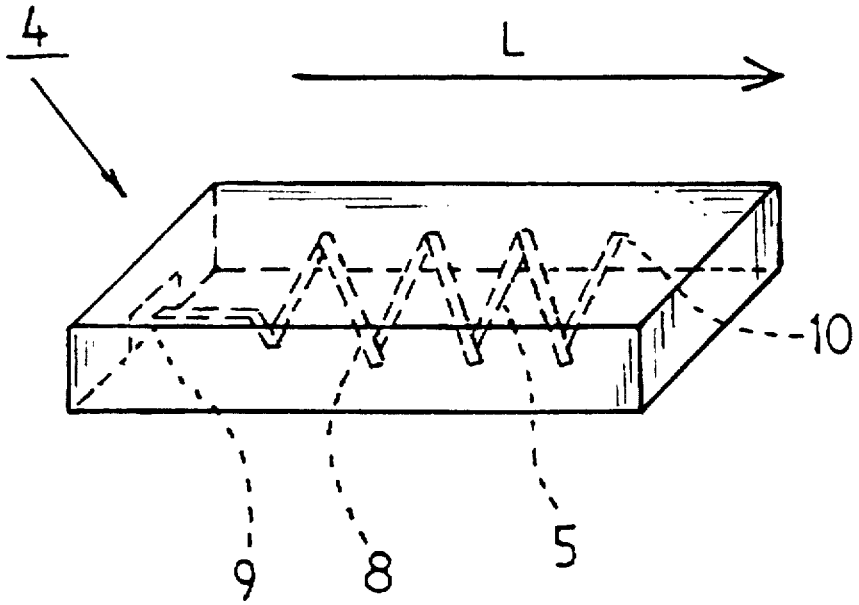
FIG. 2 is a perspective view of a substrate of the surface mount antenna of FIG. 1.
Figure 3:
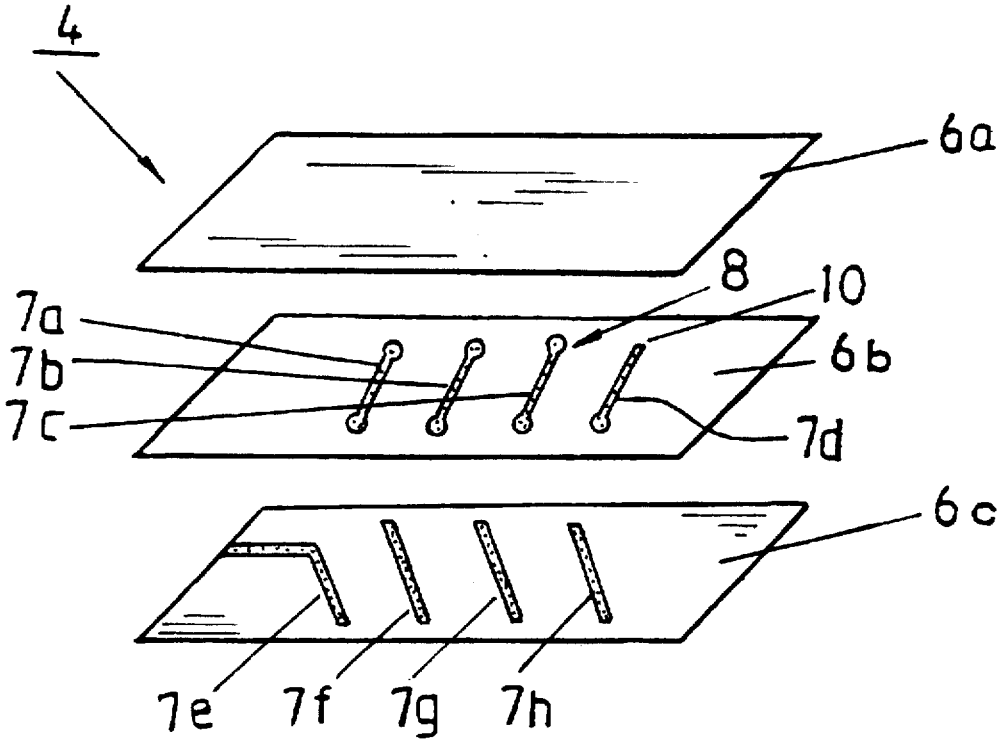
FIG. 3 is an exploded perspective view of the substrate of the surface mount antenna of FIG. 1.

A description will now be given of an embodiment of a construction of a surface mount antenna in accordance with the present invention, with reference to FIGS. 1 to 3.

Figure 1:
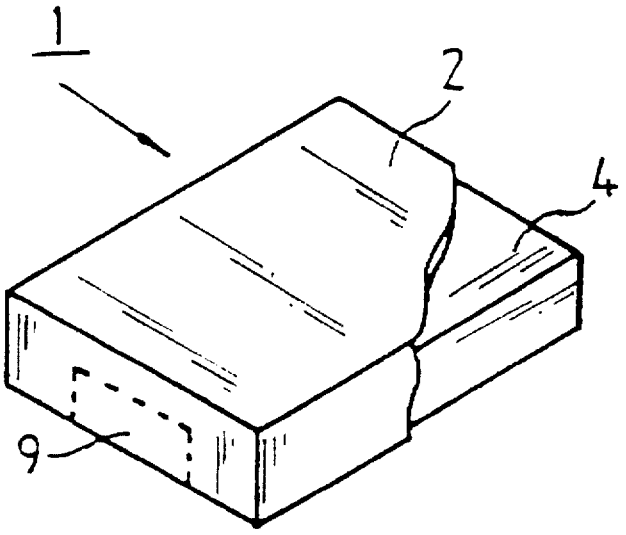
FIG. 1 is a perspective view of an embodiment of a surface mount antenna in accordance with the present invention.

Referring to FIG. 1, reference numeral 1 denotes a surface mount antenna that comprises a rectangular substrate 4. The substrate 4 comprises rectangular dielectric sheets *6a* to *6c*, each of which is made of either ceramic primarily composed of barium oxide, aluminum oxide, silica, or resin such as Teflon, or a mixture of the aforementioned ceramic and the aforementioned resin. Of the dielectric sheets, the dielectric sheets *6b* and *6c* have formed on their surface conductive patterns *7a* to *7d* and *7e* to *7h*, respectively, by printing, deposition, bonding, or plating, etc. The conductive patterns extend substantially linearly, and are made of copper, a copper alloy, or the like. The dielectric sheet *6b* has formed on its surface via hole wiring 8 which is a hole or holes filled with conductive material in the direction of the thickness of the sheet *6b*. Placing the dielectric sheets *6a* to *6c* upon each other and connecting the conductive patterns *7a* to *7h* through the via hole wirings 8 results in formation of a spiral conductive portion 5, being rectangular in cross section, along the longitudinal direction of the substrate 4, or in the direction of arrow L in FIG. 2. One end of the conductive portion 5 (or the conductive pattern *7e* end) is drawn toward a surface of the substrate 4, and connected to an-electrical supply terminal 9 that is provided on a surface of the substrate 4 in order to apply voltage to the conductive portion 5. On the other hand, the other end of the conductive portion 5 (or the conductive pattern *7d* end) is formed as a free end 10 in the substrate 4. Since a spirally-shaped conductive portion 5 is formed in the substrate 4, it is possible to reduce the size of the substrate 4 into, for example, a width of 5 mm, a depth of 8 mm, and a height of 2.5 mm.

The entire substrate 4 is covered with covering material 2 made of nonmetallic material such as glass, resin, or the like, by coating or dipping. The substrate 4 covered with the covering material 2 forms the surface mount antenna 1.

The surface mount antenna 1 constructed in the above-described manner can be placed on a printed wiring board, with its electrical supply terminal 9 soldered and connected to a wiring on the printed wiring board, or can be mounted to a member other than a printed wiring board, with a lead wire of the antenna 1 that has been drawn out from the electrical supply terminal 9 being connected to a wiring of a printed board substrate or the like.

Figure 4:
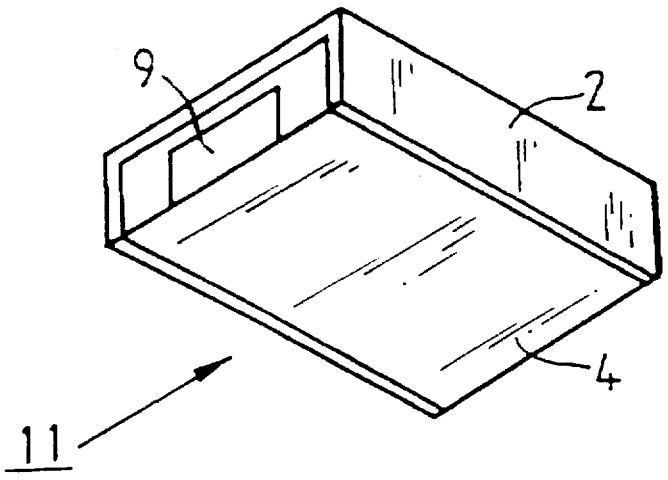
FIG. 4 is a perspective view of another embodiment of a surface mount antenna in accordance with the present invention.
Figure 5:
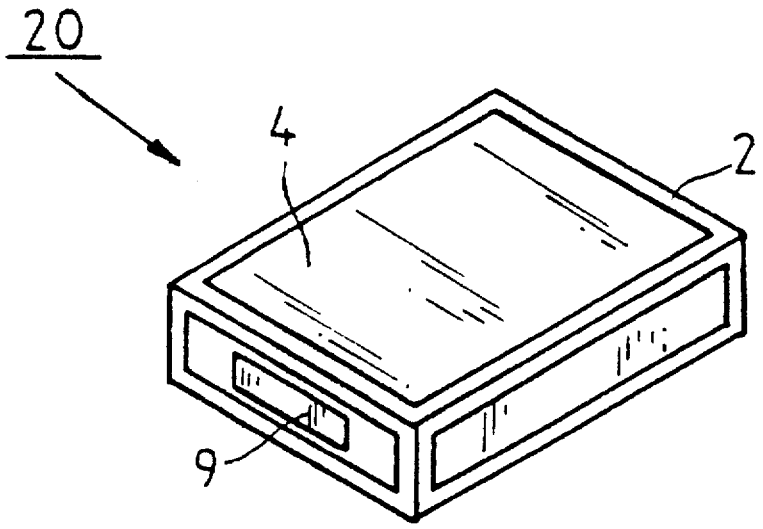
FIG. 5 is a perspective view of still another embodiment of a surface mount antenna in accordance with the present invention.
Figure 6:
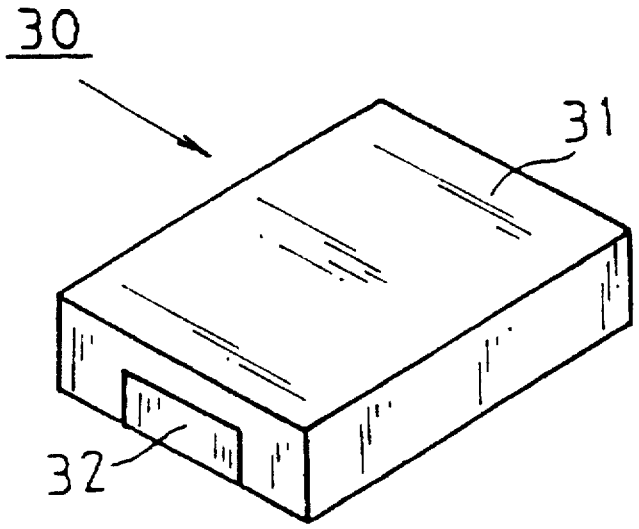
FIG. 6 PRIOR ART
FIG. 6 is a perspective view of a conventional surface mount antenna.

The covering material 2 does not have to cover the entire substrate 4. It may be made to cover part of the substrate 4 as long as the mechanical strength of the substrate is increased. Therefore, for example, as in the surface mount antenna 11 of FIG. 4, the covering material 2 may be made to continuously cover one of the main faces and side faces of the substrate 4, or as in the surface mount antenna 20 of FIG. 5, the covering material 2 may be made to cover the edges and the portions adjacent to the edges.

As described above, in the surface mount antennas 1, 11, and 20, the covering material 2 increases the mechanical strength of the substrate 4, thereby preventing the antenna from breaking when it comes into contact with another object or when it drops. In addition, the covering material protects the antenna from heat and moisture, thereby preventing deterioration of the properties of the antenna when it is used under high temperature and humidity conditions.

The winding of the conductive section in the substrate in cross section may be circular, substantially semi-circular, or substantially track-shaped and partly linear, although in the foregoing description the winding has been described as being rectangular or square in cross section.

Although in the foregoing description the conductive portion has been described as being formed in the substrate, it may be formed by winding a conductive pattern on a surface of the substrate, or by winding a wire such as a plate wire, an enamel wire, or the like along a spiral groove formed on a surface of a dielectric sheet.

Although in the foregoing description, the substrate has been described as being formed from a plurality of dielectric sheets placed upon each other, it may be formed from, for example, block-shaped dielectric members. A block-shaped substrate may also be formed from non-dielectric members such as magnetic members or a combination of dielectric members and magnetic members, which are bonded together. In such cases, the conductive portion is formed on a surface of the substrate.

In addition, although in the foregoing description, the conductive portion has been described as being formed by winding a conductive pattern along the longitudinal direction of the substrate, it may be wound in the direction of the height of the substrate in order to form the conductive portion.

Further, although in the forgoing description, the conductive portion has been described as being formed by winding the conductive pattern three dimensionally, the conductive pattern may be formed as a wave-shaped or zig-zagged pattern on a surface of the substrate or in an internal plane of the substrate.

Still further, although in the foregoing description, the substrate has been described as being rectangular parallelopiped, it may be spherical, cube-shaped, cylindrical, conical, pyramidal, or the like.

According to the surface mount antenna of the present invention, the mechanical strength of the substrate is increased because it is covered with covering material, thereby preventing the antenna from breaking when it comes into contact with another object or when it drops. In addition, it is possible to prevent deterioration of the properties of the antenna when it is being used under high temperature and humidity conditions, since it is protected from heat and moisture by the covering material.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface mount antenna comprising:

a substrate;

a conductive portion disposed at least one of in and on a surface of said substrate;

an electrical supply terminal on a surface of said substrate for applying voltage to said conductive portion;

the conductive portion having one end coupled to the electrical supply terminal and a second end left unconnected;

a covering material covering at least a portion of said substrate; and the substrate having at least one flat surface to be mounted on a mounting board;

wherein the substrate comprises a plurality of laminated layers with respective parts of the conductive portion on respective ones of the layers, via holes being provided on at least one of said layers as a portion of a part of the conductive portion on said at least one layer for interconnecting with at least one other part to form said conductive portion when said layers are placed together to form said substrate.

2. The antenna of claim 1, wherein the conductive portion is formed by one of printing, deposition, bonding and plating.

3. The antenna of claim 1, wherein the covering material comprises one of glass and resin.

4. The antenna of claim 1, wherein the covering material substantially covers all surfaces of said substrate.

5. The antenna of claim 1, wherein the covering material covers edges and portions adjacent the edges of the substrate.

6. The antenna of claim 1, wherein the covering material covers one of the main faces and side faces of the substrate.

7. The antenna of claim 1, wherein the covering material increases the mechanical strength of the substrate.

8. The antenna of claim 1, wherein the covering material protects the antenna from heat and moisture.

9. The antenna of claim 1, wherein the conductive portion is substantially a spiral.

10. The antenna of claim 1, wherein the conductive portion is one of square, rectangular, and partly linear in cross-section.

11. The antenna of claim 1, wherein each layer is a block shaped member.

12. The antenna of claim 11, wherein each block shaped member is one of a dielectric material and a magnetic material.

13. The antenna of claim 1, wherein the substrate is one of a dielectric material and magnetic material.

14. The antenna of claim 1, wherein the conductive portion comprises one of a wave-shaped and a zig-zagged pattern on a surface of the substrate.

15. The antenna of claim 1, wherein the conductive portion comprises one of a wave-shaped and a zig-zagged pattern on an internal plane of the substrate.

16. The antenna of claim 1, wherein the substrate is one of a rectangular parallelopiped and cube.

* * * * *